US010342266B2

(12) United States Patent
Oh

(10) Patent No.: US 10,342,266 B2
(45) Date of Patent: Jul. 9, 2019

(54) FUNCTIONAL UNDERPANTS FOR MALE

(71) Applicant: GAMYU.CO., LTD., Daejeon (KR)

(72) Inventor: Gil Young Oh, Daejeon (KR)

(73) Assignee: GAMYU.CO., LTD., Daejeon (KR)

( * ) Notice: Subject to any disclaimer, the term of this patent is extended or adjusted under 35 U.S.C. 154(b) by 0 days.

(21) Appl. No.: 14/419,872

(22) PCT Filed: Feb. 21, 2014

(86) PCT No.: PCT/KR2014/001401
§ 371 (c)(1),
(2) Date: Feb. 5, 2015

(87) PCT Pub. No.: WO2014/129832
PCT Pub. Date: Aug. 28, 2014

(65) Prior Publication Data

US 2015/0208732 A1 Jul. 30, 2015

(30) Foreign Application Priority Data

Feb. 21, 2013 (KR) ..... 10-2013-0018742
Jul. 9, 2013 (KR) ..... 10-2013-0080379

(51) Int. Cl.
*A41B 9/02* (2006.01)
*A41B 9/00* (2006.01)

(52) U.S. Cl.
CPC ..... *A41B 9/023* (2013.01); *A41B 9/001* (2013.01)

(58) Field of Classification Search
CPC ..... A41B 9/023; A41B 9/001
(Continued)

(56) References Cited

U.S. PATENT DOCUMENTS 4,759,355 A * 7/1988 Thrower ..... A61F 5/40 2/405
4,961,419 A * 10/1990 Tribble ..... A41B 9/023 2/403

(Continued)

FOREIGN PATENT DOCUMENTS

CN 1775125 A 5/2006
CN 2798624 Y 7/2006

(Continued)

OTHER PUBLICATIONS

Sep. 27, 2016, European Office Action for related EP application No. 14754409.2.

(Continued)

*Primary Examiner* — Richale L Quinn
*Assistant Examiner* — Anne Kozak
(74) *Attorney, Agent, or Firm* — Revolution IP, PLLC

(57) ABSTRACT

Disclosed is a functional briefs for men, including: a cloth for lining including an opening part for penis for separating the penis and scrotum, the opening part for penis receiving the penis; and a containing cloth, wherein a pocket-shaped containing cloth for penis and a containing cloth for scrotum are formed in one cloth, the containing cloth including a first curved part sewed on the front part of the cloth for lining and formed by a first wrinkled part, a second curved part formed by a second wrinkled part, and a third curved part formed by a third wrinkled part, the containing cloth being connected with a front part of the cloth for lining.

7 Claims, 9 Drawing Sheets

(58) Field of Classification Search
USPC ..... 2/403
See application file for complete search history.

(56) References Cited

U.S. PATENT DOCUMENTS

| | | | | | |
|---|---|---|---|---|---|
| 5,718,003 | A * | 2/1998 | Gwinn | A41B 9/023 | 2/400 |
| 5,875,495 | A * | 3/1999 | Thrower | D04B 1/243 | 2/236 |
| 6,038,703 | A * | 3/2000 | Chung | A41B 9/023 | 2/400 |
| 6,076,195 | A * | 6/2000 | Klein | A41B 9/023 | 2/400 |
| 6,295,651 | B1 * | 10/2001 | Kang | A41B 9/02 | 2/400 |
| 7,024,703 | B1 * | 4/2006 | Della Ratta | A41B 9/023 | 2/400 |
| 7,065,797 | B1 * | 6/2006 | Chen | A41B 9/02 | 2/400 |
| 7,578,009 | B1 * | 8/2009 | Boston | A41D 1/08 | 2/238 |
| 7,788,739 | B1 * | 9/2010 | Della Ratta | A41B 9/023 | 2/400 |
| 9,314,052 | B2 * | 4/2016 | Donmoyer | A41B 9/023 | |
| 2002/0053102 | A1 * | 5/2002 | Vartanyan | A41B 9/02 | 2/403 |
| 2004/0231034 | A1 * | 11/2004 | Cym | A41B 9/023 | 2/403 |
| 2005/0235399 | A1 * | 10/2005 | Kang | A41B 9/023 | 2/403 |
| 2005/0268380 | A1 * | 12/2005 | Sovell | A41B 9/023 | 2/400 |
| 2006/0000008 | A1 * | 1/2006 | Chong | A41B 9/023 | 2/403 |
| 2006/0162052 | A1 * | 7/2006 | Stankowski | A41B 9/02 | 2/403 |
| 2007/0277284 | A1 * | 12/2007 | Chung | A41B 9/023 | 2/78.1 |
| 2007/0277285 | A1 * | 12/2007 | Gravette | A41B 9/023 | 2/78.1 |
| 2008/0178369 | A1 * | 7/2008 | Kitsch | A41B 9/023 | 2/405 |
| 2008/0229487 | A1 * | 9/2008 | Kweon | A41B 9/001 | 2/405 |
| 2009/0106874 | A1 * | 4/2009 | Shlush | A41B 9/12 | 2/78.1 |
| 2009/0158505 | A1 * | 6/2009 | Fleming | A61F 13/471 | 2/405 |
| 2009/0178182 | A1 * | 7/2009 | Dahlquist | A41B 9/02 | 2/401 |
| 2009/0288240 | A1 * | 11/2009 | Lim | A41B 9/023 | 2/403 |
| 2011/0154560 | A1 * | 6/2011 | Hoffman | A41B 9/023 | 2/405 |
| 2011/0258756 | A1 * | 10/2011 | Avgustopulo | A41B 9/02 | 2/403 |
| 2012/0017356 | A1 * | 1/2012 | Baek | A41B 9/023 | 2/403 |
| 2012/0116345 | A1 * | 5/2012 | Dime | A41B 9/001 | 604/396 |
| 2012/0167279 | A1 * | 7/2012 | Bigney | A41B 9/02 | 2/401 |
| 2012/0167280 | A1 * | 7/2012 | Adams | A41B 9/026 | 2/403 |
| 2012/0204325 | A1 * | 8/2012 | Todd | A41B 9/02 | 2/404 |
| 2012/0255102 | A1 * | 10/2012 | Soderstrom | A41B 9/023 | 2/403 |
| 2012/0260404 | A1 * | 10/2012 | Steele | A41B 9/023 | 2/404 |
| 2012/0266361 | A1 * | 10/2012 | Maier | A41D 1/084 | 2/227 |
| 2012/0304364 | A1 * | 12/2012 | Landi | A41B 9/12 | 2/403 |
| 2013/0000013 | A1 * | 1/2013 | Schifone | A41B 9/023 | 2/403 |
| 2013/0174328 | A1 * | 7/2013 | Rolon | A41B 9/023 | 2/403 |
| 2013/0219591 | A1 * | 8/2013 | Gu | A41B 9/002 | 2/405 |
| 2014/0047620 | A1 * | 2/2014 | Ingalls | A41B 9/02 | 2/403 |
| 2014/0059744 | A1 * | 3/2014 | Lin | A41B 9/023 | 2/403 |
| 2014/0331390 | A1 * | 11/2014 | Matsumoto | A41B 9/023 | 2/403 |
| 2015/0082519 | A1 * | 3/2015 | Yoo | A41B 9/02 | 2/403 |
| 2015/0173974 | A1 * | 6/2015 | Delija | A41B 9/023 | 604/385.15 |
| 2015/0181946 | A1 * | 7/2015 | Donmoyer | A41B 9/004 | 2/403 |
| 2015/0320118 | A1 * | 11/2015 | Frantz | A41B 9/02 | 2/404 |
| 2016/0120231 | A1 * | 5/2016 | Deluca | A41B 9/023 | 2/403 |

FOREIGN PATENT DOCUMENTS

| | | | |
|---|---|---|---|
| JP | 07-6203 | U | 1/1995 |
| JP | 2005-264411 | A | 9/2005 |
| KR | 20-1998-0063519 | U | 11/1998 |
| KR | 20-1998-063519 | U | 11/1998 |
| KR | 10-2002-0051908 | A | 6/2002 |
| KR | 1020020051908 | A | 6/2002 |
| KR | 200315923 | Y1 | 6/2003 |
| KR | 200379226 | Y1 | 6/2003 |
| KR | 10-2011-0040994 | A | 4/2011 |
| KR | 1020120067702 | A | 6/2012 |
| KR | 10-1198513 | B1 | 11/2012 |

OTHER PUBLICATIONS

International Search Report for PCT/KR2014/001401 mailed on Jun. 25, 2014.

* cited by examiner ( A )

( B )

( A )

( B )

FUNCTIONAL UNDERPANTS FOR MALE

BACKGROUND

The present invention relates to functional briefs for men, more precisely, a functional briefs for men wherein penis and scrotum are contained automatically in independent area without separating them by physical act.

According to many studies of male sexual function, hormone secretion, sperm production and activities, the change in ambient temperature leads to the change in body temperature and the change in male sexual function as well, as portrayed by the media.

The human body shows homeostasis in orer to maintain a constant body temperature. Like the human body, the scrotum also shrinks and enlarges as room temperature decreases or increases respectively, which is also the result of homeostasis for keeping the temperature of the scrotum stable.

In other words, the rising ambient temperature leads to increase in the temperature of human body, which also results in increase in the temperature of the testicles. In this situation, homeostasis allows the scrotum to enlarge so that the testicles can cool down. The problem is that warm weather makes the scrotum expand a lot larger to cool off and in turn it requires more space in conventional briefs as they are typically tight between thighs. The result is that the penis is pressured downwards and that makes it sweatier. Furthermore, the sweat that covers the scrotum and the vicinity of men's genital organs is usually difficult to evaporate, which in turn increases the temperature of the testicles and causes uncomfortable feeling. This recurring discomfort prompts men to relieve the sweat by reaching for the scrotum and raising it awkwardly upward by hand.

This habit is an instinctive action to keep the temperature of the testicles constant so that deterioration in sexual function can be prevented.

The conventional arts have played a good role in fixing erect penis to point to hypogastric area. However, the briefs uncomfortably separating the penis and the scrotum make them shake from side to side and make the penis fall toward groin.

Especially, this condition can more commonly occur in the areas with high ambient temperature, which is why ergonomically designed functional briefs for men are sought to comfortably separate and contain the penis and the scrotum and keep the testicles cool.

SUMMARY

It is the object of the present invention to provide functional briefs for men wherein the penis and the scrotum are smoothly separated without any means or physical force by putting and keeping the penis and the scrotum separated and contained under the circumstances of intensive exercise or when the penis expands or shrinks.

To achieve the above object, the present invention is characterized in that the functional briefs for men (100) have a round triangle-shaped opening part for penis (200) and a crescent moon-shaped opening part for scrotum (210) sewed to a cloth for lining (140) on the front cloth (120), and the cloth for the lining (140) sewed with a containing cloth (330) comprising a containing part for penis (300) and the containing part for scrotum (310) in front of the cloth for lining (140) by the first cut part (201) and the second cut part (202) are sewed with the front cloth (120). The front cloth (120) sewed with the cloth for lining (140) is sewed with the rear cloth (110) according to the features explained in the first preferred embodiment.

In the first preferred embodiment, the functional briefs for men are characterized in separating penis (10) and scrotum (20) respectively into the opening part for penis (200) and the opening part for scrotum (210) to be protected and contained without physical force while the wearer is putting on it so that the wearer finds it comfortable and refreshing.

In the first preferred embodiment, a separating cloth (170) between the opening part for penis (200) and the opening part for scrotum (210) is able to separate the penis (10) and the scrotum (20) under any circumstances where the penis expands or shrinks. Plus, thanks to the cloth for lining (140) which is capable of absorbing and discharging sweat caused by increasing body temperature from intensive exercise, the temperature of the scrotum is optimized.

In the first preferred embodiment, even when the penis shrinks and moves a lot to the left or right, the round rectangle-shaped opening part for penis (200) is not allowed to get into the cloth for lining (140) so that the overlap part (11) of the penis (10) and the scrotum (20) is separated by the separating cloth (170). As a result, the briefs remain dry without sweat.

In the second preferred embodiment, in order for the penis (10) to be separated by itself, the functional briefs for men (100) comprise a second cloth for lining (500) with the opening part for penis (200) which is formed at the center of the briefs and the penis (10) is guided through.

The functional briefs for men (100) also comprise: a first curved part (161) and a second curved part (162) which allow the penis (10) to easily positioned through the containing part after being connected to the second cloth for lining (500) and to a connecting part (190) with a third cut part (203) folded from left to right based on the center symmetry line (301), each pocket-shaped curved part due to the fact that a third curved part (163) is connected, the containing cloth (330) with the containing part for penis (300) and a containing part for the scrotum (310), the front cloth (120) which is connected to the connecting part (190) in the left and the right of the containing cloth (330) and forms the front part of the briefs, and the rear cloth (110) which is connected to the connecting part (190) in the left and the right of the front cloth (120) and forms the rear part of the briefs.

At the same time, the lower part of the front cloth (120) is connected to the lower part of the rear cloth (110) and the connecting part (190), and is located at the center of the front cloth (120). The second cloth for lining (500) which is connected to the connecting part (190) in the inside of the containing cloth (330) is cut in a way the length of the second cloth for lining (500) is shorter than that of the containing cloth (330) so that the second cloth for lining (500) comprises the opening part for scrotum (210) which is formed between the rear cloth (110) and the second cloth for lining (500).

The technical solution of the functional seamless briefs for men (800) in the third preferred embodiment is comprised in the first, second and the third preferred embodiments. The functional seamless briefs for men (800) comprises: the opening part for penis (200) which is formed in the vicinity of the penis (10) to separate the penis (10) and the scrotum (20), a seamless separating cloth (810) formed in the lower opening part for scrotum (200) and the seamless functional briefs for men which allows a piece of cloth to have the opening part for a scrotum (210) formed in the vicinity of scrotum (20) of the lower seamless separating cloth (810).

The functional briefs for men of the present invention provide the following advantageous effects.

In the present invention, the containing cloth (330) is sewed with a cloth for lining (40) with the opening part and the front cloth (120) and the rear cloth (110) are sewed so when the wearer wears the functional briefs for men, following advantageous effects can be obtained.

The penis and the scrotum are separated in enough room with good ventilation. The separation between the penis and the scrotum is able to reduce the temperature of the scrotum, which does not allow the bottom of the penis and the scrotum to keep sweat without bad odor. In turn, skin diseases such as heat rash are prevented and a habitation of germs is not created for boosting hygiene.

The penis and the scrotum are separated under any circumstances of intensive exercise, climbing or daily activities, which prevents male infertility by reducing the temperatures of the scrotum.

The wearer feels a sense of touch in this briefs thanks to the fact that cutting and sewing are carried out based on the shape of the penis and the scrotum, the penis and the scrotum are not separated with physical force, rather automatically separated in ample room for convenience while the wearer is wearing it.

Thanks to the enough room of the containing cloth (330), when the wearer is walking or doing work out, bad air in pants goes out while fresh air outside of the pants comes in reducing the temperature and the humidity of the scrotum because the movement of the legs cause the movement of the containing cloth (330), which causes the air ventilation explained hereinbefore.

In addition to the effects explained above, the design of the present invention facilitates industrial productivity, leading to an increase in the industrial productivity.

These features described above can be accomplished when the present invention is manufactured using conventional fabrics, which means that the unit cost can be lower by using ordinary fabrics instead of high-cost fabrics.

BRIEF DESCRIPTION OF THE DRAWINGS

The application of the preferred embodiments of the present invention is best understood with reference to the accompanying drawings, wherein.

DETAILED DESCRIPTION

Figure 1:
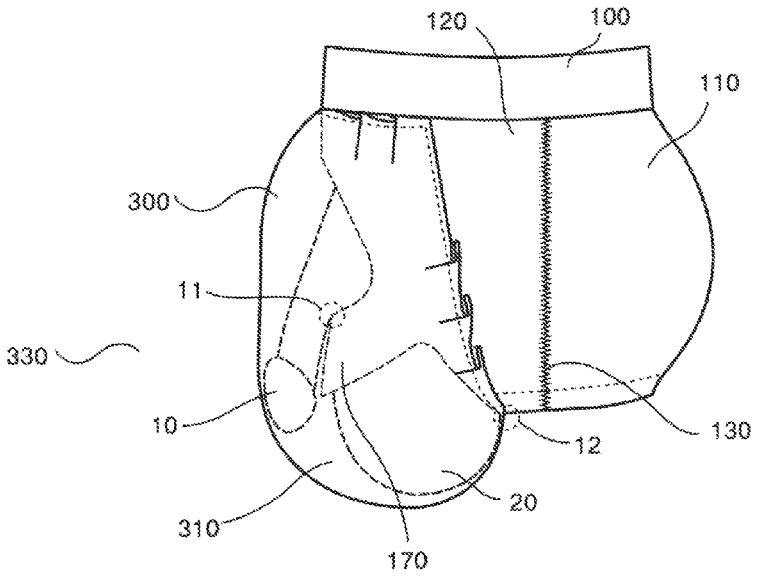
FIG. 1 is a detailed drawing illustrating how to use the functional briefs for men and functional parts according to the first preferred embodiment of the present invention.

According to the second preferred embodiment of the present invention,

The functional briefs for men (100) according to FIGS. 6 to 12 include the second cloth for lining (500) wherein the opening part for penis (200), in which the penis (10) is inserted for the penis (10) to be naturally separated and contained, is formed at the center.

The reason why the cloth for lining (140) and the second cloth for lining (500) use different marks is the features of the second preferred embodiment where only the opening part for penis (200) formed in the cloth for lining is included or the height of the second cloth for lining (500) with the opening part for penis (200) and the separating cloth (170) is shorter than that of the cloth for lining (140) with the opening part for penis (200), the separating cloth (170) and the opening part for a scrotum (210) in the first exemplary embodiment, and has different constitution compared to the cloth for lining (140).

Figure 7:
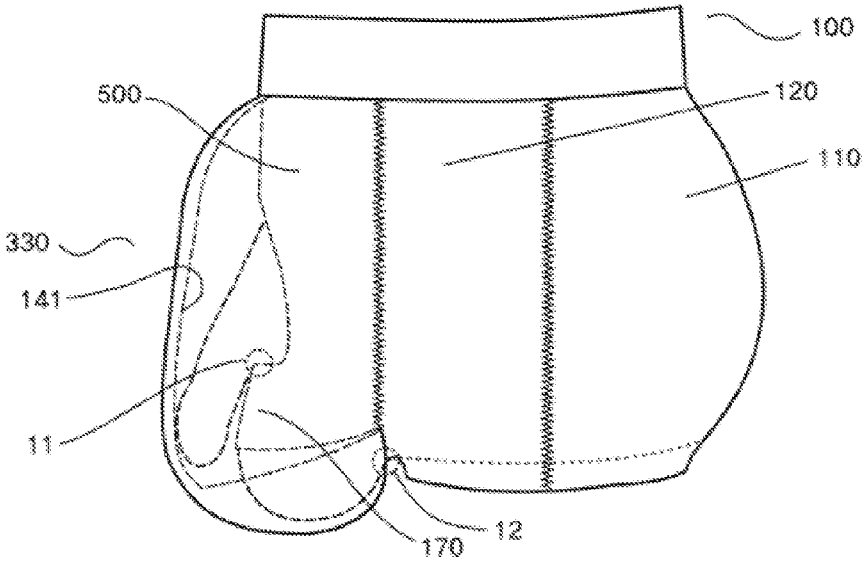
FIG. 7 is an assembly drawing of the functional briefs for men according to the second preferred embodiment.
Figure 12:
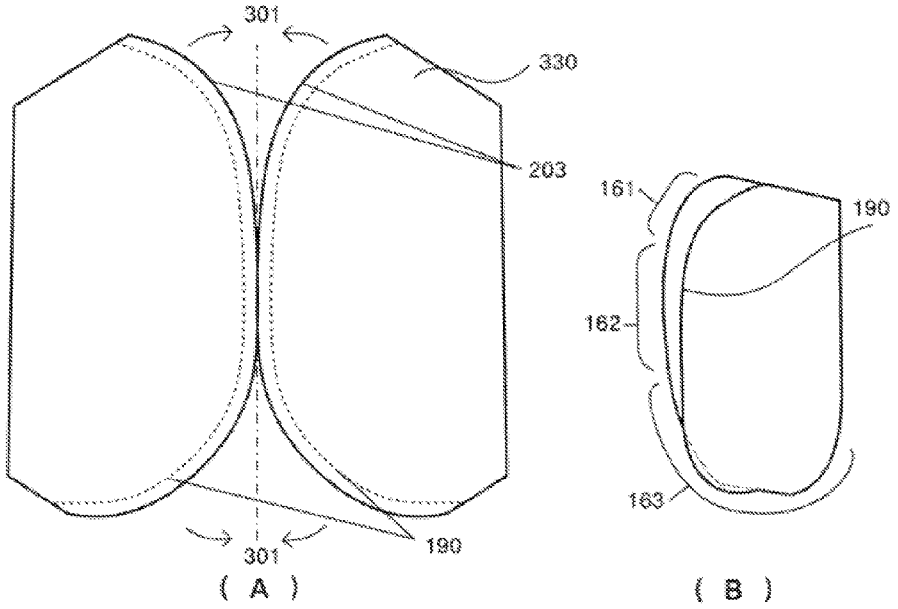
FIG. 12 is a formation drawing of the containing part according to the second preferred embodiment.
Figure 13:
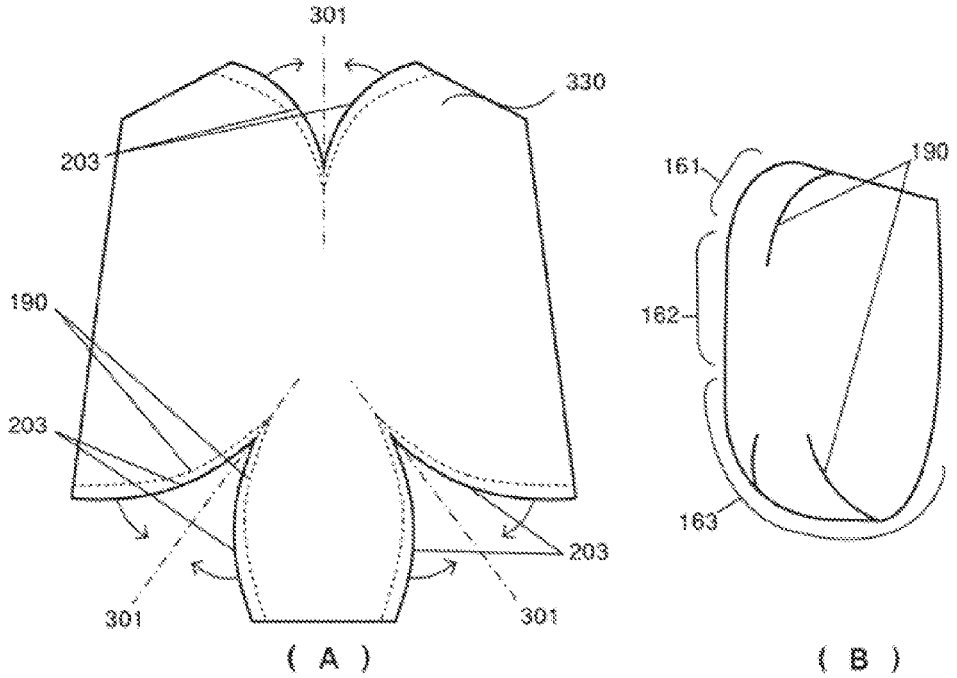
FIG. 13 is a drawing illustrating the containing parts to be transformed in various ways by the changes of the cut parts according to the different preferred embodiments of the present invention.

In addition, according to FIGS. 7 and 12, the first curved part (161) and the second curved part (162) are formed in order to allow the penis (10) to be easily contained after they are connected to the second cloth for lining (500) and connected to the connecting part (190) with the left and the right cut part (203) folded, based on the centered symmetry line (301). Then, the first curved part (161) and the second curved part (162) formed are connected to the third curved part (163) and each curved part is formed into a pocket shape. The containing part for penis (300) and the containing part for a scrotum (310) are connected to the containing cloth (330); and the connecting part (190) in the left and the right of the containing cloth (330), and the front cloth (120) forming the front part of the briefs and the connecting part (190) in the left and the right of the front cloth (120), and comprise the rear cloth (110) forming the rear part of the briefs.

Figure 9:
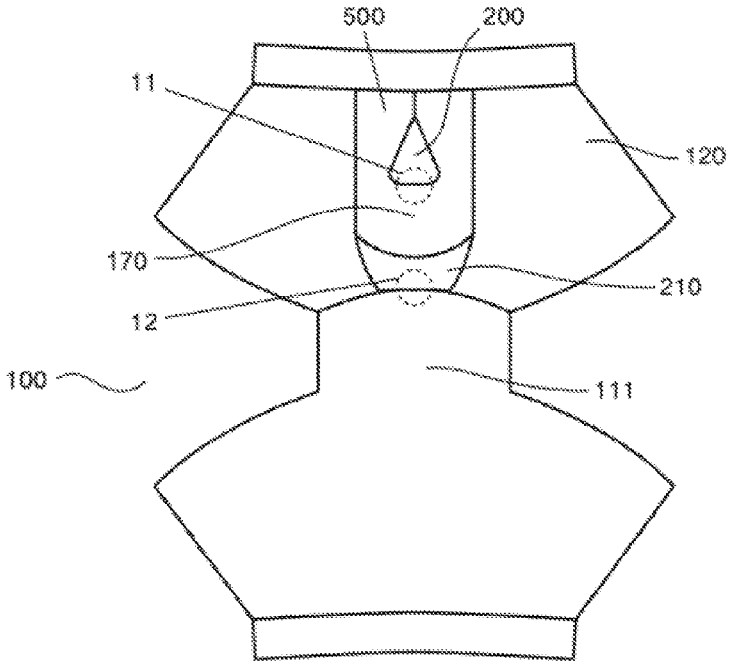
FIG. 9 is a development drawing illustrating the inside of the briefs of which sides are cut and the connection of the lower part of the front cloth and the lower part of the rear part according to the second preferred embodiment.

In addition, according to FIG. 9, the lower front cloth (120) is connected to the lower rear cloth (110) and the connecting part (190), and is located at the center of the front cloth (120). The second cloth for lining (500) which is located at the center of the front cloth (120) and connected to the connecting part (190) in the inside of the containing cloth (330) is cut shorter compared to the containing cloth (330), which allows the opening part for a scrotum (210) to be included between the rear cloth (110) and the second cloth for lining (500).

Figure 6:
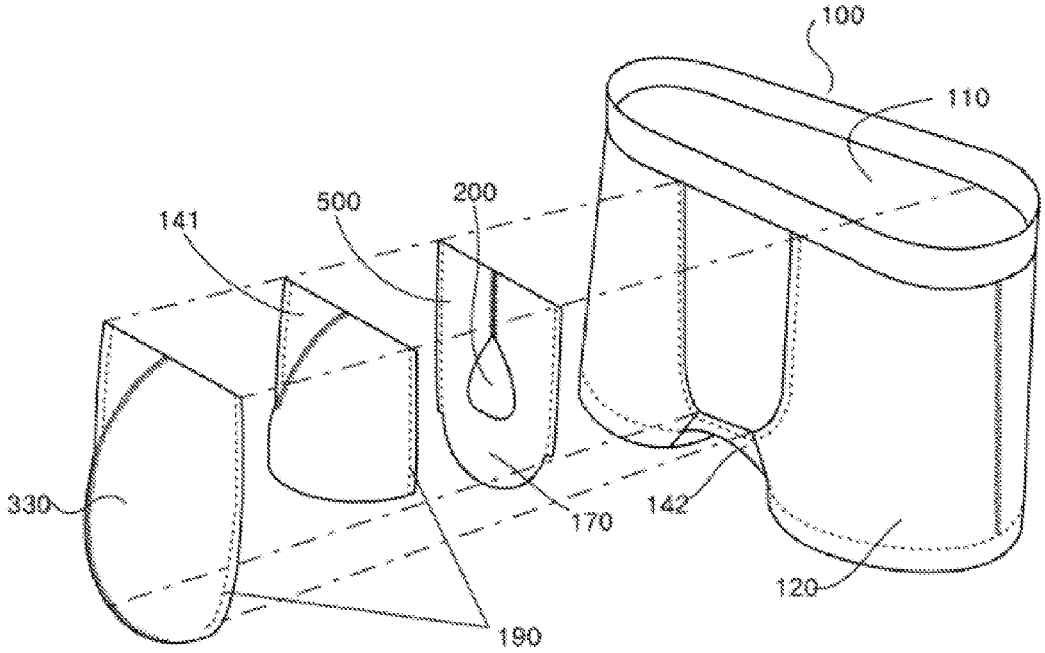
FIG. 6 is an exploded-view of the functional briefs for men according to the second preferred embodiment of the present invention.
Figure 11:
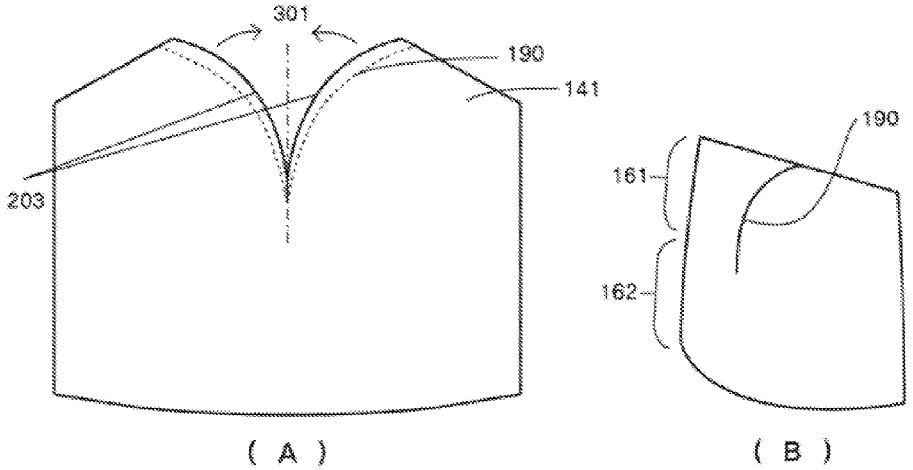
FIG. 11 is a formation drawing of the middle part according to the second preferred embodiment.

In addition, according to FIGS. 6 and 11, a bottom cloth (142) inserted between the containing cloth (330) and the second cloth for lining (500) is the same with the second cloth for lining (500). In order for the penis (10) to be easily inserted into the containing cloth (330), when the left and the right cut part (203) at the upper center is folded based on the symmetry line (301) and connected to the connecting part (190), a middle cloth (141) with the first curved part (161) and the second curved part (162) is included.

Figure 8:
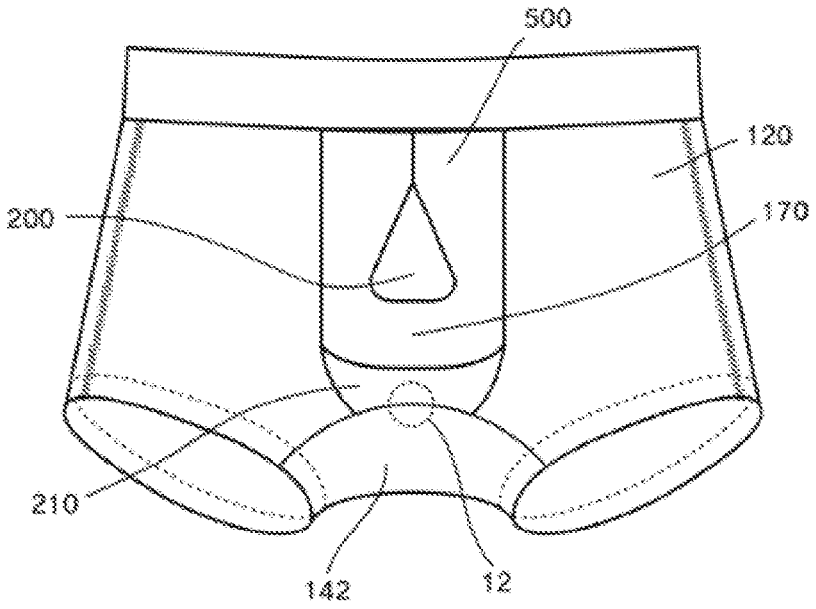
FIG. 8 is an assembly drawing illustrating the cloth for lining and the functional briefs for men according to the second preferred embodiment with the containing parts separated.
Figure 8:
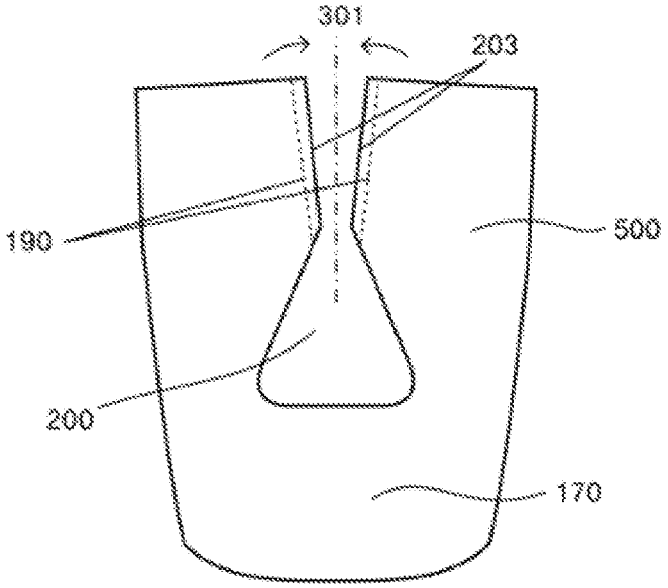

In addition, according to A and B of FIG. 8, the second cloth for lining (500) comprises the separating cloth (170) which is formed in the lower opening part for penis (200).

Figure 10:
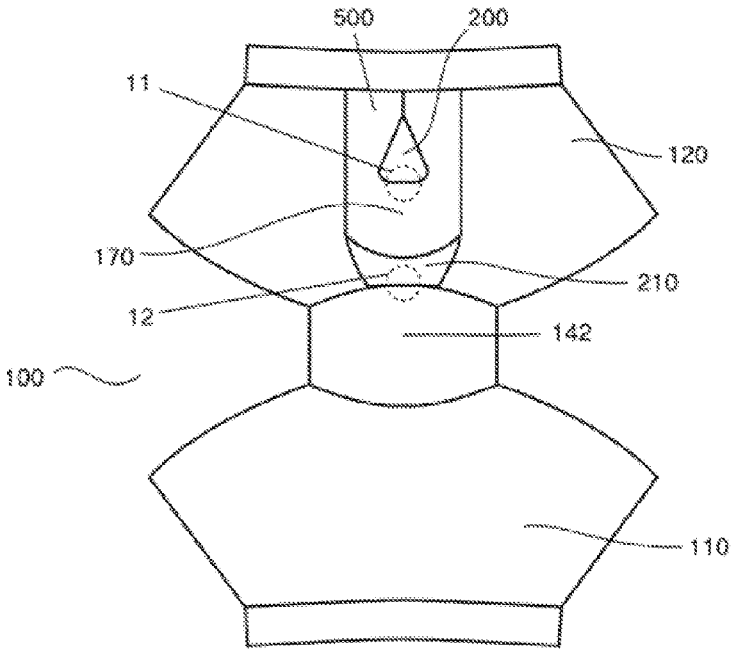
FIG. 10 is a development drawing illustrating the inside of the briefs of which sides are cut and the connection of the bottom part between the front cloth and the rear cloth according to the second preferred embodiment.

In addition, according to FIG. 10, it illustrates the functional briefs for men comprising: the bottom cloth (142) which is connected to the connecting part (190) in the lower front cloth (120) of which some part comprises the containing cloth (330), the bottom cloth (142) which is connected to the connecting part (190) in the bottom of the rear cloth (110) and the bottom cloth (142) with the opening part for scrotum (210) formed in the lower second cloth for lining (500). So the first preferred embodiment illustrated in FIG. 1 through 5 has the same constitution except for: the second cloth for lining (500) which is shorter than the containing cloth (330) with the opening part for penis (200), the separating cloth (170) and the containing cloth (330) which are formed in the lower opening part for penis (200) in the second cloth for lining (500), the opening part for scrotum (210) which is formed in the middle cloth (141), between the front cloth (120) and the bottom cloth (142).

Therefore, in terms of the constitutions which play the same roles in the first preferred embodiment and the third preferred embodiment, the same marks are used for the constitutions. However, in terms of the constitutions which play the same roles but are included in different constitution, the different marks are used for the constitution (the separating cloth is described as 170 while the seamless separating cloth for penis is described as 810) and a brief explanation, rather detailed one is included.

According to the second preferred embodiment of the present invention, the functions are the same in the first preferred embodiment and the third preferred embodiment and the effects of the functions are explained as following.

The opening part for scrotum (210) formed in the cloth for lining (140) has the opening part for scrotum (210) to be formed between either the rear cloth (110) or the bottom cloth (142), and the second cloth for lining (500), which allows the production of the briefs (100) to speed up for higher productivity.

The middle cloth (141) is able to absorb and evaporate one drop or two drops of urine remaining in the penis (10) and a layer of the containing cloth (330) prevents the silhouette of the penis (10) from being shown. At the same time, the scrotum is able to easily emit heat because the height of the middle cloth (141) has shorter height of the cloth for lining (140) and the same height of the second cloth for lining (500), which makes the containing part for a scrotum (310) one layer.

Figure 14:
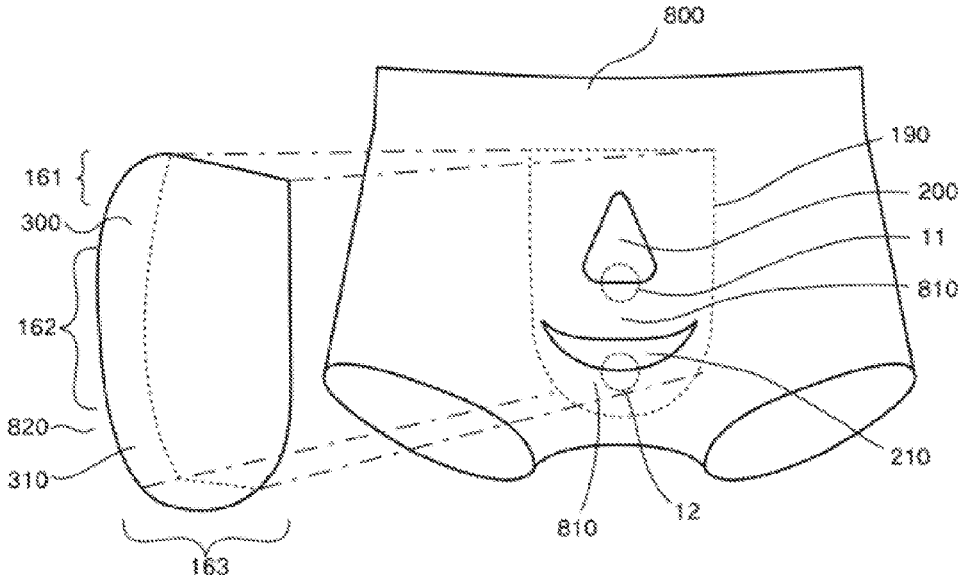
FIG. 14 is an exploded-view of the seamless briefs for men according to the third preferred embodiment of the present invention.

FIG. 14 illustrates an exploded-view of the seamless functional briefs for men according to the third preferred embodiment.

According to the third preferred embodiment of the present invention, in terms of the functional seamless briefs for men (800) illustrated in FIG. 18, the functional seamless briefs for men (800) comprises in a cloth: the opening part for penis (200) which is formed in the vicinity of the penis (10) to separate the penis (10) and the scrotum (20), the separating cloth (810) formed in the lower opening part for penis (200) and the opening part for scrotum (210) formed in the vicinity of the scrotum (20) in the lower seamless separating cloth (810).

At the same time, the functional seamless briefs for men (800) is seamless functional briefs for men with features where the opening part for scrotum (210) is formed in the vicinity of the scrotum (20) in a cloth for separating the scrotum (20).

In addition, when the opening part for penis (200) and the opening part for scrotum (210) are connected to the front of the connecting part (190), in the upper part of the briefs, the first round curved part (161) is formed to contain the penis (10) and the scrotum (20) which are separated by the opening part for penis (200) and the opening part for scrotum (210), the lower part of the briefs which looks like a pocket is connected to the third curved part (163). This constitution above allows the functional seamless briefs for men (800) to have a seamless containing part (820) where a pocket shape is formed in a cloth.

The first preferred embodiment of the present invention is described in more detail with reference to the accompanying drawings.

Accordingly, the drawings and descriptions are to be regarded as illustrative in nature and not restrictive, and also the reference numerals designate elements throughout the specification.

The first preferred embodiment shows a key constitution of a functional briefs for men comprising a cloth for lining (140), an opening part for penis (200), an opening part for scrotum (210), a separating cloth (170), a front cloth (120), a containing part for penis (300), a containing part for scrotum (310), a first cut part (201), a second part (202), a cut part (203), a containing cloth (330), a rear cloth (110), a curved part (161), (162), (163), and a wrinkled part (151), (152), (153).

Figure 2:
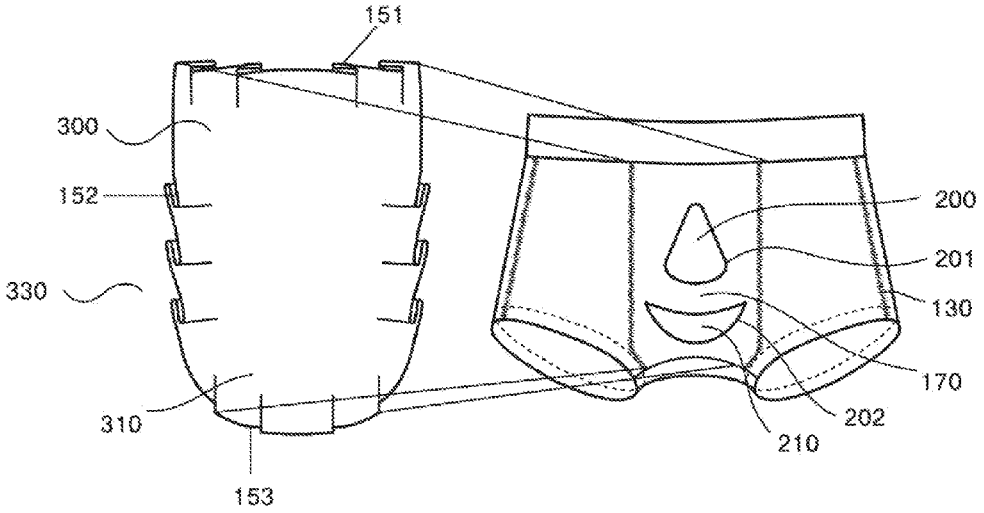
FIG. 2 is a drawing illustrating the containing parts of the functional briefs for men and the several pieces of the separated cloth for lining according to the first preferred embodiment of the present invention.

According to FIG. 1, the present invention is related to the functional briefs for men wherein the functional briefs for men is sewed with the rear cloth (110) after the cloth for lining (140) with the containing cloth (330) and the front cloth (120) are attached by sewing on a sewing line (130) and, according to FIG. 2, the cloth for lining (140) is comprised by the first cut part (201) located in the middle part of the cloth for lining (140), the opening part for scrotum (210) is comprised by the second cut part (202) at the bottom part of the of the lining (140), and the separating part (170) is comprised by the cut parts (201) and (202).

Figure 4:
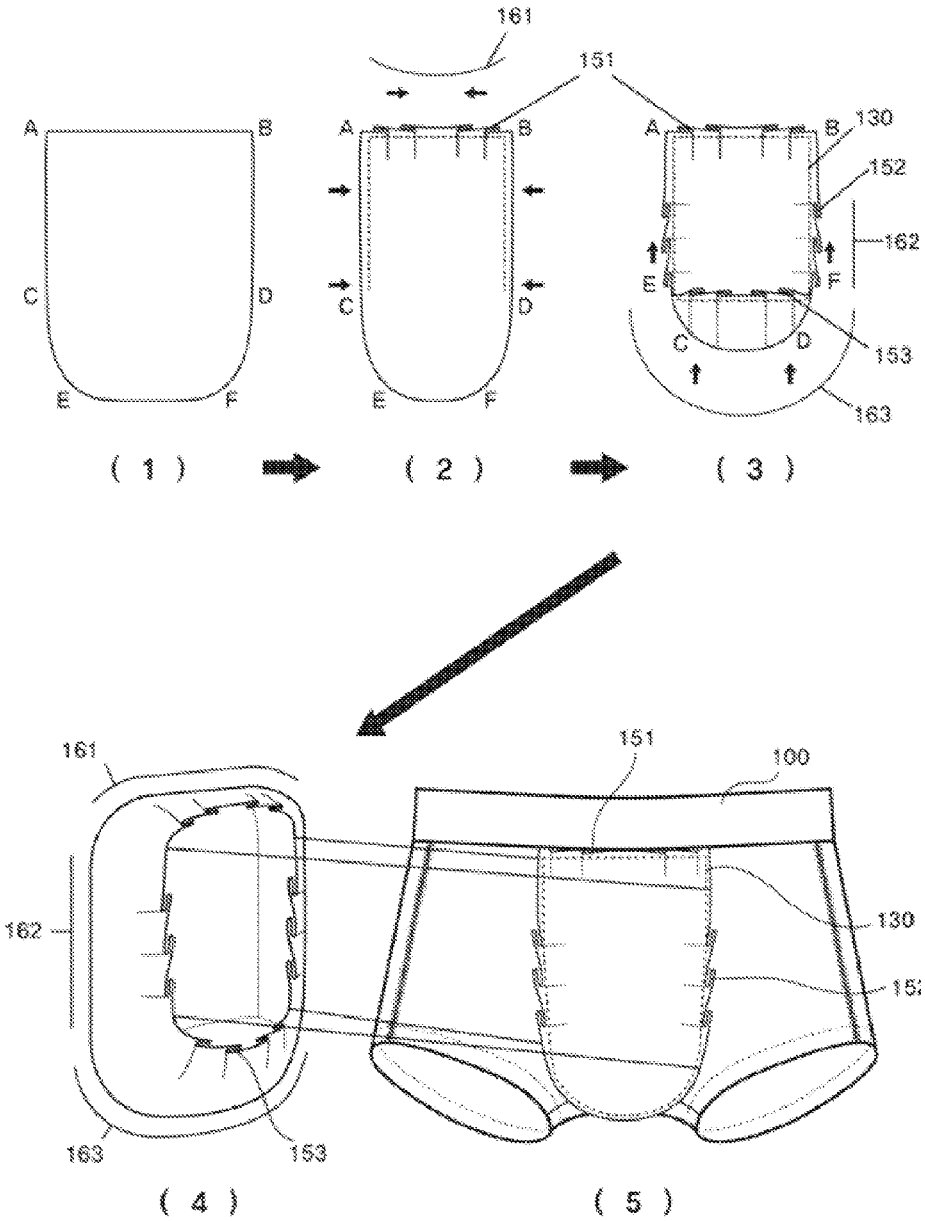
FIG. 4 is a brief drawing illustrating a way of forming containing parts by the wrinkled parts of the functional briefs for men according to the first preferred embodiment of the present invention.

According to FIG. 4, the containing cloth (330) which is sewed with the cloth for lining (140) on the sewing line (130) to make the first wrinkled part (151), the second wrinkled part (152) and the third wrinkled part (153). Making the first wrinkled part (151) forms the first curved part (161) between A and B, making the second wrinkled part (152) forms the second curved part (162) between C and D for making the containing part for penis (300) and making the third wrinkled part (153) forms the third curved part (163) between E and C, and F and D for making the containing part for scrotum (310).

At this time, the wrinkled parts (151), (152), (153) of the containing cloth (330) can be sewed on the sewing line (130), and attached to the front part of the cloth for lining (140).

Figure 5:
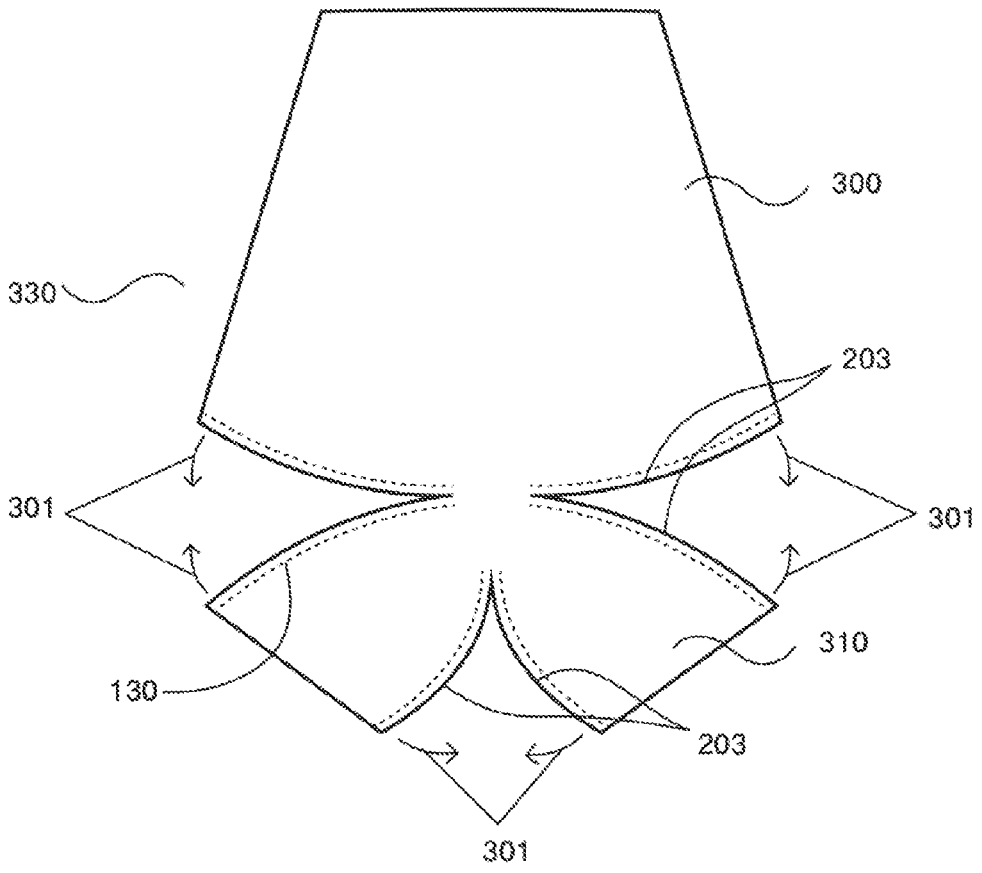
FIG. 5 is a drawing illustrating the functional briefs for men with the containing parts which are cut in various ways according to the first preferred embodiment of the present invention.

Further, according to FIG. 5, it shows the containing cloth (330) changed by cutting comprising the third cut part (203) with a specific curvature, and this curvature helps to comprise enough size for containing penis, which requires the first curved part (161) and the second curved part (162) of the containing part for penis (300) to be smaller than the third curved part (163) of the containing part for scrotum (310).

The cloth for lining (140) with the containing cloth (330) is produced by sewing the formed containing cloth (330) with the cloth for lining (140).

A detailed description of function of each constitution of the first preferred embodiment of the present invention follows based on the constitutions of the first preferred embodiment.

Figure 3:
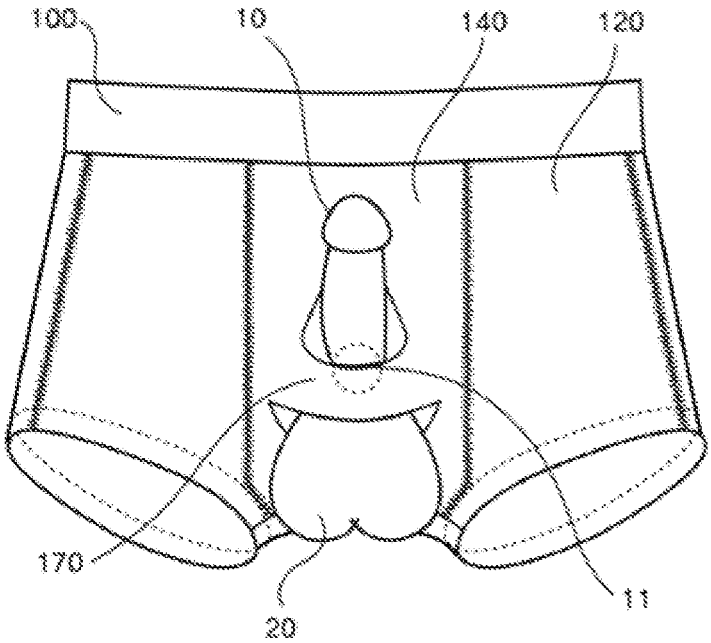
FIG. 3 is a drawing illustrating the function of the opening parts with the containing parts separated according to the first preferred embodiment of the present invention when the penis in the functional briefs for men expands and shrinks.
Figure 3:
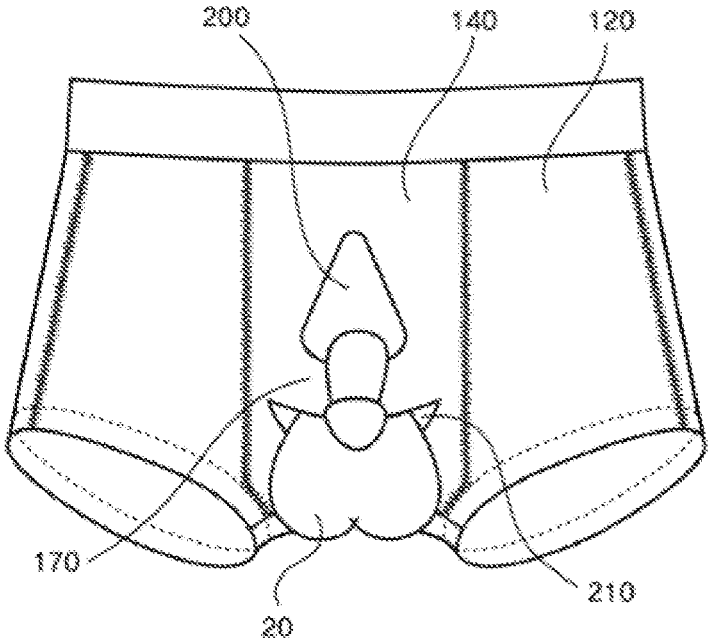

According to FIGS. 1 through 3, when the separating cloth (170) is pressed down due to the shrinkage of penis (10), it is desirable that the opening part for penis (200) is located in the first overlap (11) where the penis and the separating cloth (170) meet allowing the wearer feel comfortable, and the lower part of the separating cloth (170) hangs loose on the upper part of scrotum (20).

During the shrinkage of penis, it is desirable that a second overlap (12) on the opening part for scrotum (210) is located in an area where the scrotum (20) and the groin are comfortably separated.

It is desirable that the material of the cloth for the lining (140) has ability to easily absorb sweat and allow it to evaporate and the first overlap (11) and the second overlap (12) that the penis (10) and the scrotum (20) meet with are not pressured in order to help improve blood circulation.

The containing cloth (330) of the present invention is not separated with the containing part for penis (300), the containing part for scrotum (310) but connected in a functional cloth. When it comes to the containing cloth (330) and the cloth for lining (140), it is enough to choose them if they are known to absorb sweat and allow it to evaporate more quickly than cotton does.

As the functional cloth is readily available from various sources, it is desirable that in order to decrease the temperature of the scrotum Coolmax fabric, Coolon fabric, Tencel fabric (Lyocell), hemp fabric, linen and Spandex fabric, or a cloth with combination of those materials are used for the absorption and the evaporation of sweat.

According to FIG. 3, it is desirable that the shape of the opening part for penis (200) on the cloth for lining (140) is triangle without sharp points, the shape of the opening part for scrotum (210) is like a crescent moon and the height of the center of the separating cloth (170) is about 3 to 4 cm.

The opening part for penis (200) and the opening part for scrotum (210) can be differently cut in shape and size. For example, the opening part for penis (200) comes in various shapes of a vertical rectangle, a vertical oval, a reverse triangle and a circle, and in various sizes. The opening part for scrotum (210) can also come in various shapes of a horizontal rectangle, an oval and a circle. However, it is desirable for the opening part for penis (200) and the opening part for scrotum (210) to be a triangle shape or like a crescent moon because only in that case the cloth for lining (140) is less affected by the separating cloth (170) which is drooped by the first cut part (201) and the second cut part (202).

According to FIGS. 1 and 3, the opening part for penis (200) and the opening part for scrotum (210) on the cloth for lining (140) can allow the penis (10) and the scrotum (20) to be separated regardless of situation where the penis and the scrotum expand or shrink, or when the wearer is intensively doing a work out, climbing or actively moving. At the same time, under the condition of the penis (10) to be pressed down, the separating cloth (170) prevents the penis (10) from being touched by the scrotum (20) and the containing cloth (330) prevents the scrotum (20) from being touched by the groin. Plus, the enough size of the containing cloth (330) encourages fresh air to get into the briefs, preventing the penis (10) and the scrotum (20) from sweat and humidity.

As explained hereinbefore, compared to the conventional arts, the present invention is able to improve sexual function and enhance a sense of touch and at the same time, prevents increasing the temperature of scrotum, which is one of the reasons for male infertility.

The first preferred embodiment shows the functional briefs for men (100) which is made out of the cloth for lining (140) with the opening part for penis (200) and the opening part for scrotum (210), and to be sewed on the containing cloth (330) and the front cloth (120) and the rear cloth (110) in order.

According to the second preferred embodiment, in FIGS. 6 and 12 the functional briefs for men (100) comprises a second cloth for lining (500) with the opening part for penis (200) which is formed at the center of the second cloth for lining (500) to separately contain the penis (10).

(The reason why the mark of the cloth for lining (140) and the mark of the second cloth for lining (500) are different is the features of the second preferred embodiment, which means that the second cloth for lining (500) only comprises the opening part for penis (200), or the height of the second cloth for lining (500) only with the opening part for penis (200) and the separating cloth (170) is shorter and has different constitution, compared to the cloth for lining (140) with the opening part for penis (200), the separating cloth (170) and the opening part for scrotum (210) in the first preferred embodiment).

Also, according to FIGS. 7 and 12, the second cloth for lining (500) covers the front of the briefs and is sewed on a connecting part (190) after the third cut part (203) is folded from side to side based on a symmetry line (301), and the first curved part (161) and the second curved part (162) are formed to easily contain the penis (10), with the third curved part (163) connected. As a result, each curved part is formed like a pocket and the opening part for penis (300) and the containing part for scrotum (310) are sewed with the containing cloth (330) and the left and the right side of the connecting part (190) of the containing part for penis (300), and the front cloth (120) and the left and the right side of the connecting part (190) of the front cloth (120), and comprise the rear cloth (110) forming the rear of the briefs.

Also, according to FIG. 9, the lower front cloth (120) is sewed with the lower rear cloth (110) and the connecting part (190). The second cloth for lining (500) which is located at the center of the front cloth (120) and connected with the connecting part (190) in the containing cloth (330) is cut shorter than the containing cloth (330) to contain the opening part for scrotum (210) formed between the rear cloth (110) and the second cloth for lining (500).

In addition, according to FIGS. 6 and 11, a middle cloth (141) which is inserted between the containing cloth (330)

and the second cloth for lining (500) has the same height with the second cloth for lining (500) and the third cut part (203) is folded based on the symmetry line (301) and sewed on the connecting part (190) to allow the containing cloth (330) to easily contain the penis (10), and the middle cloth (141) has the first curved part (161) and the second curved part (162).

In addition, according to A and B of FIG. 8, the second cloth for lining (500) covers the separating cloth (270) which is formed in the lower opening part for a penis (200).

In addition, according to FIG. 10, it is the functional briefs for men, comprising: a side of a bottom cloth (142) which is connected to the connecting part (190) of the front cloth (120) with the containing cloth (330), another side of the bottom cloth (142) which comprises the bottom cloth (142) which is connected to the lower rear cloth (110), and the connecting part (190) and the bottom cloth (142) with the opening part for a scrotum (210) in the lower second cloth for lining (500).

The constitutions of this briefs are the same with the constitutions of the first preferred embodiment described in FIGS. 1 through 10 except for the constitutions comprising the second cloth for lining (500) which has the opening part for penis (200) and is shorter than the containing cloth (330), the separating part (170) and the containing cloth (330) which are formed in the lower opening part for penis (200) of the second cloth for lining (500), and the opening part for scrotum (210) which is formed between the front cloth (120) and the bottom cloth (142).

Therefore, regarding the constitutions which play the same role, described in the first preferred embodiment and the third preferred embodiment, the same marks are used for the same constitutions but if the constitutions play the same roles but are included in different constitution, the different constitutions have different marks (A separating cloth (170) is described into a seamless separating cloth for penis (810)), with no specific explanation but simple one is added.

A function in the second preferred embodiment of the present invention has the same function of the first preferred embodiment and the third preferred embodiment, and has the following effects.

The opening part for scrotum (210) formed in the cloth for lining (140) has the opening part for scrotum (210) between either the rear cloth (110) or the bottom part (142) and the second cloth for lining (500), which boost the speed of a functional briefs for men (100).

The middle cloth (141) absorbs and evaporates a couple of drops of urine remaining in the penis (10) and a layer of the containing cloth (330) prevents the silhouette of the penis (10) from being shown. At the same time, the scrotum is able to easily emit heat because the height of the middle cloth (141) has shorter height of the cloth for lining (140) and the same height of the second cloth for lining (500), which makes the containing part for a scrotum (310) one layer.

FIG. 14 is an exploded view of seamless functional briefs for men based on the third preferred embodiment.

According to the third preferred embodiment of the present invention, FIG. 14 shows a functional seamless briefs for men (800) made of a piece of cloth comprising: the opening part for penis (200) which is formed in front of the penis to separate the penis (10) and the scrotum (20), a seamless separating cloth for penis (810) formed in the lower opening part for penis (200) and the opening part for scrotum (210) which is formed in the vicinity of the scrotum (20).

At the same time, in the functional seamless briefs for men (800), the opening part for scrotum (210) is formed in a piece of cloth for putting the penis (20) through the opening part for scrotum (210).

Plus, the functional seamless briefs for men (800) also have a seamless containing part (200) with a pocket formed in a piece of cloth, by connecting the opening part for penis (200) and the opening part for scrotum (210) to the connecting part (190) in the front, forming the first curved part (161) in the upper part to contain the penis (10) and the scrotum (20) separated by the opening part for penis (200) and the opening part for scrotum (210), and connecting the third curved part (163) shaped like a pocket to the lower part.

The seamless separating cloth for penis (810) between the opening part for penis (200) and the opening part for scrotum (210) is formed when the functional seamless briefs for men (800) is being woven, which is why the mark of the seamless separating cloth for penis (810) is different from the mark of the separating cloth (170) in the functional briefs for men (100) in different preferred embodiments.

Unlike the containing cloth (330) in the other preferred embodiments, a mark of a seamless containing part (820) is also used as the different mark because the first, the second and the third curved parts (161), (162), (163) are formed while the seamless containing part (820) is woven.

Even though the functions and the terms are the same in the different preferred embodiments, the constitution is different and different marks are used.

In the first, second and the third preferred embodiments, the form and the shape of the containing cloth (330) can be different according to the location and the curvature value of the third cut part (201). Therefore, the shape and form are not limited but it is enough to contain the penis and the scrotum.

The reason why the containing cloth (330) has the first curved part (161), the second curved part (162) and the third curved part (163) is that the penis (10) and the scrotum (20) should be naturally contained into the containing part without physical force and the reason why the volume of the containing part is bigger than the volume of the penis (10) and the scrotum (20) is that removing bad air by giving fresh air into the containing cloth (330) in pants as the containing cloth (330) moves a bit due to the movement of the contained penis (10) and the contained scrotum (20) which also moves a bit caused by the movement of legs.

As a result, bad air is replaced with fresh air, which leads the temperature of the scrotum (20) and the groin to lower, and humidity to be removed.

As explained hereinbefore, the form and the shape of the containing cloth (330) can be different according to various designs.

Regarding the middle cloth (141), the width of the middle cloth (141) is smaller than the width of the containing cloth (330), which is a way to prevent causing the wrinkles of the middle cloth (141) when the connecting part (190) is connected to the middle cloth (141) by the containing cloth (330) so that the penis (10) can be smoothly inserted.

Only upper middle cloth (141) has the symmetry line (301) by the third cut part (203), which is for the purpose of giving a protuberance to the upper middle cloth (141) by inserting the middle cloth into the upper containing cloth (330), and another purpose for the penis (10) put through the opening part for a penis (200) to be put through smoothly again the containing cloth (330) and the middle cloth (141). The middle cloth is the same with the second cloth for lining (500) and in length and shorter than the cloth for lining (140).

The cloth for lining (140) is for separating the penis (10) and the scrotum (20) from the body can have only rounded triangle-shaped opening part for penis (200). In the lower area of the rounded triangle-shaped opening part for penis, the separating cloth (170) can be formed. Under the separating cloth (170), the opening part for scrotum (210) can be formed.

The roles of the opening part for penis (200), the separating cloth (170) and the opening part for scrotum (210) formed in the cloth for lining (140) are to separate the first overlap (11) from the second overlap (12), and separate the left and the right groin from each thigh, and absorb and evaporate the sweat from the first overlap (11) and the second overlap (12) where the penis and the scrotum are overlapped so that the wearer feels comfortable and fresh in the present invention.

So far the desirable constitutions and functions have been described.

The following are the detailed explanation of the specific functions of those constitutions.

It is desirable for the upper separating cloth (170) located under the opening part for penis (200) in the cloth for lining (140) to be located in the first overlap (11) where the penis and the scrotum are overlapped in order for the wearer not to feel uncomfortable when the penis (10) moves downward by the shrinkage of the penis and it is also desirable that the lower separating part (170) is hung in the center of the scrotum (20).

When the scrotum (20) shrinks, it is desirable for the second overlap (12) in the lower opening part for scrotum (210) to be located for comfortably separating the scrotum (20) with the groin.

If the first overlap (11) and the second overlap (12) are tightened up, at first the wearer would feel comfortable. However, over time, it negatively affects blood circulation, which causes uncomfortable feeling. Therefore, for wearer to feel comfortable, the first overlap and the second overlap may smoothly touch the sexual organ, rather than be tightened too much.

The containing cloth (330) of the present invention comprises the containing part for penis (300) and the containing part for scrotum (310) as a pocket not to be separated. As a result the penis (10) and the scrotum (20) are contained in the containing cloth (330) together so that the wearer feels comfortable despite gravity.

The opening part for penis (200) or the opening part for scrotum (210) in the cloth for lining (140) comes in various shapes and sizes. According to the preferred embodiments, the shape of the opening part for penis (200) can be a triangle or a vertical oval with different sizes and the shape of the opening part for scrotum (210) can be a horizontal rectangle, an oval or a circle but it is desirable for the shape of the opening part for scrotum (210) to be a reversed trapezoid, rectangle, horizontal oval and crescent moon.

It is desirable that the shape of the opening part for penis (200) is a triangle or a vertical oval because the first overlap (11) is less saggy. The functional briefs for men (100) of the present invention do not limit the shape of the cloth for lining (140) and the second cloth for lining (500) or the shape of the opening part for penis (200) and the opening part for scrotum (210) in the functional seamless briefs for men (800).

The opening part for penis (200), the opening part for scrotum (210) and the seamless separating cloth (810) are able to allow the penis (10) and the scrotum (20) to be separated regardless of situation where the penis (10) and the scrotum (20) expand or shrink, or when the wearer is intensively doing a work out, climbing or actively moving.

Even though the penis (10) shrinks, the penis does not touch the scrotum (20) by the separating cloth (170) and the scrotum (20), the groin and the thighs are completely separated by the containing cloth (330). Plus, due to the fact that the size of the containing cloth (330) is big enough, the containing cloth (330) moves caused by the movement of the legs during sports events and various activities, which encourages air to be ventilated. As a result, the penis (10) and the scrotum (20) are protected from sweat, high humidity and temperature.

It means that under the conventional arts that are focused on separating the penis (10) and the scrotum (20) with the groin and the thighs for the briefs to tightly cover the penis (10) and the scrotum (20), the temperature of some parts of the sexual organ can be reduced since thermal conductivity in the body is not considered. The problem is that thermal conductivity increases the temperature of the other part of the sexual organ, which in turn increases the quantity of heat overall.

Unlike the conventional arts, the present invention is designed in an ergonomic way so that the total quantity of heat of the penis (10) and the scrotum (20) decreases and the penis (10) and the scrotum (20) are separated and contained while the wearer is putting on the invention, and the wearer feels fresh and comfortable thanks to the flowing air caused by the movement of legs.

As explained hereinbefore, the functional briefs for men with unique constitution provides different effects which cannot be seen in the conventional arts, enhances a sense of touch and prevent the scrotum (20) from getting warmer by increasing body temperature. In the end, the functional briefs for men can prevent male infertility.

According to the first, second, and third preferred embodiment, due to the unique constitution which is completely different from that of the conventional arts, the penis (10) and the scrotum (20) are separated from each other and contained when the briefs are worn.

Thanks to this uniqueness, an increase in the unit price caused by using high-end fabric is prevented and the level of uncomfortable feelings caused by the contact between parts of the sexual organs is minimized by the ease of the contact and the productivity of the briefs is improved.

Those skilled in the art will appreciate that the concept and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended claims.

The invention claimed is:

1. A functional briefs for men, comprising:

a lining cloth having a first opening part for penis, the first opening part being formed at a center of the lining cloth;

a containing cloth having a first containing part for the penis and a second containing part for scrotum which are connected together and covering an entire outer portion of the lining cloth, wherein the lining cloth and the containing cloth are layered in an aligned manner so that an upper width of the lining cloth and the containing cloth is the same, wherein the containing cloth is connected from the top to the bottom at the left and right sides thereof to a front part of the lining cloth and including first, second, and third curved parts, the first curved part and the second curved part forming to help the penis to be contained in the containing cloth by folding left and right cut parts based on a symmetry line and by connecting the third curved part to the first and second curved parts;

a front cloth which is connected to the left and the right side of the lining cloth and the containing cloth, and forms a front part;

a rear cloth which is connected to the left and the right side of the front cloth and forms a rear part, wherein a lower part of the front cloth is connected to a lower part of the rear cloth;

a second opening part for the scrotum which is formed between the rear cloth and the lining cloth, the second opening part being formed below the first opening part so that the second opening part is separated from the first opening part by a separating part of the lining cloth; and a middle cloth which is inserted between the containing cloth and the lining cloth, having the same overall length from the top to the bottom at the left and right sides as the lining cloth, wherein the first curved part and the second curved part are formed by folding the left and the right side of a cut part in an upper center based on the symmetry line and connected to the connecting part of the containing cloth to help put the penis through the first opening part of the containing cloth.

2. The functional briefs for men according to claim 1, wherein the separating part is formed between the first opening part for penis and the second opening part for the scrotum.

3. The functional briefs for men according to claim 1, further comprising a bottom cloth, wherein one part of the cloth is connected to the lower part of the front cloth including the containing cloth, and the other part of the bottom cloth is connected to the lower part of the rear cloth; and wherein the opening part for the scrotum is formed between the lower part of the lining cloth connected to the inner area of the containing cloth and the bottom cloth.

4. The functional briefs for men according to claim 1, wherein the middle cloth covers the first opening part for the penis and has a shorter length than the lining cloth, the middle cloth being layered between the lining cloth and the containing cloth.

5. The functional briefs for men according to claim 4, wherein the containing cloth covers the lining cloth and the middle cloth.

6. The functional briefs for men according to claim 5, wherein the lining cloth, the middle cloth, and the containing cloth are layered in an aligned manner so that an upper width of the lining cloth, the middle cloth, and the containing cloth is the same.

7. The functional briefs for men according to claim 4, wherein the front cloth is connected to the left and the right side of the lining cloth, the middle cloth, and the containing cloth.

* * * * *